US008720926B2

(12) United States Patent
Adams et al.

(10) Patent No.: US 8,720,926 B2
(45) **Date of Patent: *May 13, 2014**

(54) CHILD MOBILITY CHAIR

(71) Applicant: ZChair, LLC, Ham Lake, MN (US)

(72) Inventors: Zachary Adams, Plymouth, MN (US); Kent Nienaber, Ham Lake, MN (US)

(73) Assignee: ZChair, LLC, Ham Lake, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/930,742

(22) Filed: Jun. 28, 2013

(65) Prior Publication Data

US 2013/0292917 A1 Nov. 7, 2013

Related U.S. Application Data

(63) Continuation of application No. 13/467,344, filed on May 9, 2012, now Pat. No. 8,496,261.

(60) Provisional application No. 61/527,764, filed on Aug. 26, 2011, provisional application No. 61/519,861, filed on Jun. 1, 2011.

(51) Int. Cl.
*A61G 5/02* (2006.01)
*A61G 5/00* (2006.01)

(52) U.S. Cl.
CPC ... *A61G 5/00* (2013.01); *A61G 5/02* (2013.01)
USPC ..... 280/250.1

(58) Field of Classification Search
USPC ..... 280/250.1, 304.1
See application file for complete search history.

(56) References Cited

U.S. PATENT DOCUMENTS

| | | | | |
|---|---|---|---|---|
| 2,795,422 | A * | 6/1957 | Bartlett | 482/119 |
| 3,450,416 | A * | 6/1969 | Mulder | 280/211 |
| 4,066,273 | A | 1/1978 | Lohr | |
| 4,591,182 | A | 5/1986 | Wood | |
| 4,655,470 | A * | 4/1987 | Lin | 280/211 |
| 5,028,064 | A | 7/1991 | Johnson | |
| 5,116,067 | A | 5/1992 | Johnson | |
| 6,626,487 | B1 | 9/2003 | Buitendach | |
| D550,971 | S | 9/2007 | McConnell | |
| D553,865 | S | 10/2007 | Buitendach | |
| D570,970 | S | 6/2008 | Buitendach | |
| 2010/0138984 | A1 | 6/2010 | Buitendach | |

* cited by examiner

*Primary Examiner* — Tony Winner
(74) *Attorney, Agent, or Firm* — Haugen Law Firm PLLP

(57) ABSTRACT

A mobility chair is arranged for a high degree of maneuverability, and is particularly useful for handicapped individuals in need of a highly stable and maneuverable carriage. The mobility chair may be particularly useful for children, and includes a seat positioned between first and second wheels of a first wheel set, wherein the axial spacing dimension of the first and second wheels is greater than the axle height. The mobility chair is arranged for pivotability about the first wheel set axle to permit the user to freely pivot forward while in the seat of the chair, with the pivoting being limited in both circumaxial directions about the axle axis.

5 Claims, 12 Drawing Sheets

CHILD MOBILITY CHAIR

CROSS-REFERENCE TO RELATED APPLICATIONS

This application is a continuation of U.S. patent application Ser. No. 13/467,344, filed on May 9, 2012 and entitled "Child Mobility Chair", which itself claims priority to U.S. Provisional Patent Application Ser. No. 61/527,764, filed on Aug. 26, 2011 and entitled "Child Mobility Chair", and to U.S. Provisional Patent Application Ser. No. 61/519,861, filed on Jun. 1, 2011 and entitled "Child Mobility Chair", the contents of which being incorporated herein in their entirety.

FIELD OF THE INVENTION

The present invention relates to mobility devices generally, and more particularly to a wheelchair type device that may be particularly useful for children. The device of the present invention offers secure mobility not obtainable in conventional wheelchairs, and therefore improves the quality of life for children with physical limitations to their hips and legs.

BACKGROUND OF THE INVENTION

Wheel chair-type mobility devices for individuals with physical limitations have been employed for centuries with various designs intended to assist the user in moving from place to place. Most commonly, wheel chair-type devices present a substantially conventional chair arrangement that is made mobile through motorized or manually-operated wheels. Conventional wheel chair-type devices therefore provide stability and limited mobility to users with physical limitations.

While wheel chair-type devices have been extensively designed to accommodate adults, child-size wheel chairs are typically nothing more than adult-configured chairs in a reduced size. Such a conventional approach to the design of child wheel chairs, however, fails to address the unique needs and desires of child users. For example, children, and particularly small children and toddlers commonly interact with objects on or near the floor, such as toys. Conventional wheel chair designs inhibit, or outright prevent child users from reaching to objects on the floor with their hands, and particularly to a position on the floor in front of the wheel chair.

In addition to the lack of access to the floor or ground surface, conventional child wheel chair devices have limited maneuverability, in that they typically employ relatively large wheels and a seating position substantially elevated off from the floor. The overall relatively large chassis of typical child wheel chair devices results in difficult turning, as well as an increased mass that may be difficult for small children and toddlers to manipulate on their own. Typical wheel chairs position the user so that the center of gravity of the combination of the user and the chair is forward of the main wheel axis, and therefore requires front wheels or casters in constant contact with the ground or floor surface to maintain the stability of the wheel chair. Such an arrangement results in a static seating orientation for the user, and limits the maneuverability around corners and in small spaces.

It is therefore an object of the present invention to provide a mobility chair that may be particularly well adapted for child users, and which is relatively low to the ground and compact to dramatically increase the maneuverability in comparison to conventional wheel chair devices. Moreover, the present mobility chair not only lowers the overall center of gravity, rendering a highly stable device, but also positions the center of gravity behind the main wheel axis. In this manner, the user may shift the center of gravity of the combined weight of the user and the chair to a position forward of the main wheel axis by leaning their upper body slightly forward, causing the mobility chair to pivot downwardly at its front about the main wheel axis to an orientation which the user has ready axis to the ground or floor surface in front of the mobility chair. Pivot stops or front casters limit the forward pivoting, while not coming into contact with the ground or floor surface when the combined center of gravity is behind the main axis.

It is another object of the present invention to provide a mobility chair that facilitates user access to a ground or floor surface in front of the chair apparatus.

The mobility chair is designed to be low to the ground and compact giving the user the ability to reach things as they maneuver the two main wheels that are close to the side of the chair. The chair is designed with the center of gravity behind the main axis of the main wheels such that rear casters are employed to distribute the weight between the main wheels and the rear casters, and to minimize rearwardly tipping in a first operational mode. The user may lean forward to shift the overall center of gravity in front of the main axis to pivot the chair about the main axis, and to lift the rear casters from engagement with the ground or floor surface. This situation is a second operational mode to facilitate user access to the ground or floor surface to the front and sides of the chair. The compact design of the chair and wheels allows the user greater freedom and flexibility to interact with objects around them.

The mobility chair may employ raised front casters to permit the chair to tip slightly forward about the main axis without tipping over, such as in the case of a user shifting forward to pick something up or play with something in front of the chair in the second mode of operation. As the user moves back to an upright position, the chair returns to its normal position by pivoting about the main axis to re-establish engagement with the rear casters and main wheels in the first mode of operation.

A polyurethane molded seat is preferably used to hold the user in an upright position freeing their arms for maneuvering the mobility device.

The use of rear swivel casters provides stability to the chair and allows it to be quickly maneuvered without tipping. The arrangement of the main wheels and the rear casters permit changes in direction, thus being easily pivotable about an axis extending through the chair to enhance the overall maneuverability of the chair.

A foot rest on the front of the chair provides a space for the user to put their feet, and helps prevent feet from dragging on the floor and from bumping objects that could cause injury.

Bumpers on the front and back of the chair are used to prevent the chair from marking furniture, walls, and other objects that it may come in contact with.

The chair is made of lightweight materials and may include a handle allowing the chair to easily be carried and/or directed by another individual to assist in maneuvering the chair while the user is seated. The handle is therefore typically secured to, or is part of the frame, so that an extension handle member may be employed to allow tall individuals (adults) to selectively control the chair.

The mobility chair can be of various different sizes to accommodate users with varying body dimensions, and typically is configured for use by a child.

SUMMARY OF THE INVENTION

By means of the present invention, individuals with physical limitations of their legs due to injury or illness may have a highly maneuverable carriage that may be operated in a manner similar to wheelchairs. The apparatus of the present invention facilitates interaction by the user with a ground or floor surface adjacent the mobility apparatus. Specifically, a user may selectively pivot the apparatus circumaxially about a main axle, so as to "tip" the apparatus forward and backward to a desired limited extent. In some embodiments, the ability to tip the mobility apparatus circumaxially about the main axle, in combination with a low overall height of the device, permits the user to reach with their hands to pick up and manipulate objects on the ground or floor surface while remaining secured in the mobility apparatus.

In one embodiment, a mobility chair of the present invention includes a frame having an upper side and a lower side, with the frame being bisected by a vertical bisecting plane into a front portion and a rear portion. A first wheel set is rotatably secured to the frame about a first axle axis, wherein the first wheel set has first and second wheels axially spaced apart along the first axle axis by a first wheel spacing dimension. The first and second wheels have a first radius having a first axle height of the first axle axis, with the first wheel spacing dimension being greater than the first axle height. A first axle plane parallel to the bisecting plane and a second axle plane perpendicular to the bisecting plane each extend through the first axle axis. The seat is secured to the frame and is positioned at the upper side of the frame and between the first and second wheels to locate a center of gravity of the chair rearwardly from the first axle plane. The seat has a base portion with a seating surface defining a seating zone at which a user sits facing generally frontwardly. The seating surface is below the second axle plane. A second wheel set is secured to the frame rearwardly of the first axle plane, and includes one or more pivotable first casters each having a first pivot axis that is parallel to the bisecting plane, and a first rotation axis that is perpendicular to the first pivot axis and below the second axle plane. The one or more first casters are pivotable about a respective first pivot axis and rotatable about a respective first rotation axis.

In another embodiment, a mobility chair of the present invention includes a first wheel set having first and second wheels that are axially spaced apart along a first axle axis by a first wheel spacing dimension. A first radius of at least one of the first and second wheels define a first axle height, wherein the first wheel spacing dimension is greater than the first axle height. First and second mutually perpendicular axle planes extend through the first axle axis. A seat having a front portion and a rear portion bisected by a bisecting plane that is parallel to the first axle plane is included and has a first base portion with a seating surface defining a seating zone at which a user sits facing generally frontwardly. The seating surface is below the second axle plane. A second wheel set is positioned rearwardly of the first axle plane, and includes one or more third wheels each defining upper and lower third wheel tangent points on a circumference thereof. The lower third wheel tangent point is distal from the second axle plane relative to the upper third wheel tangent point, and is contained within a first lower tangent plane that is perpendicular to the bisecting plane. The first lower tangent plane extends through a first wheel set tangent point of the first and second wheels at an intersection with the first axle plane.

DETAILED DESCRIPTION OF THE PREFERRED EMBODIMENTS

Figure 1:
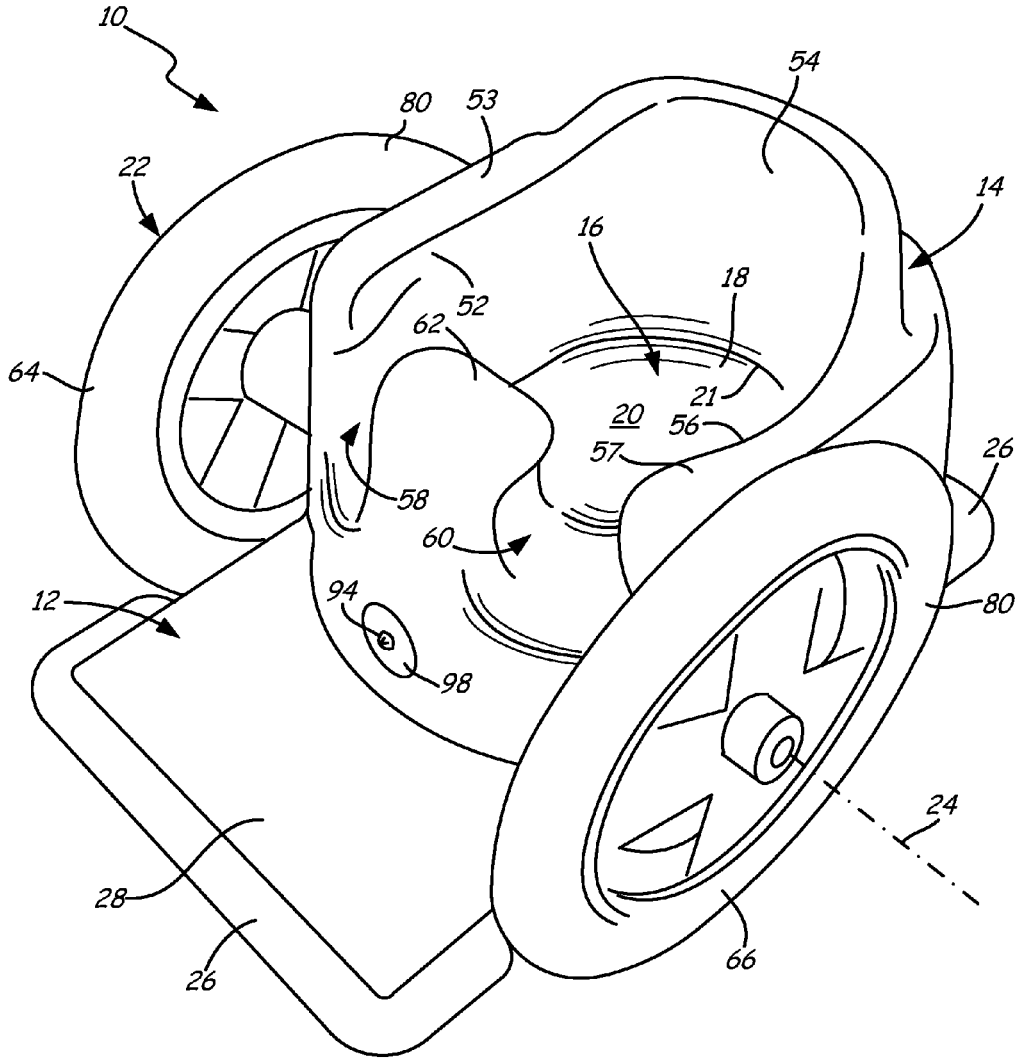
FIG. 1 is a top perspective view of a mobility chair of the present invention.
Figure 2:
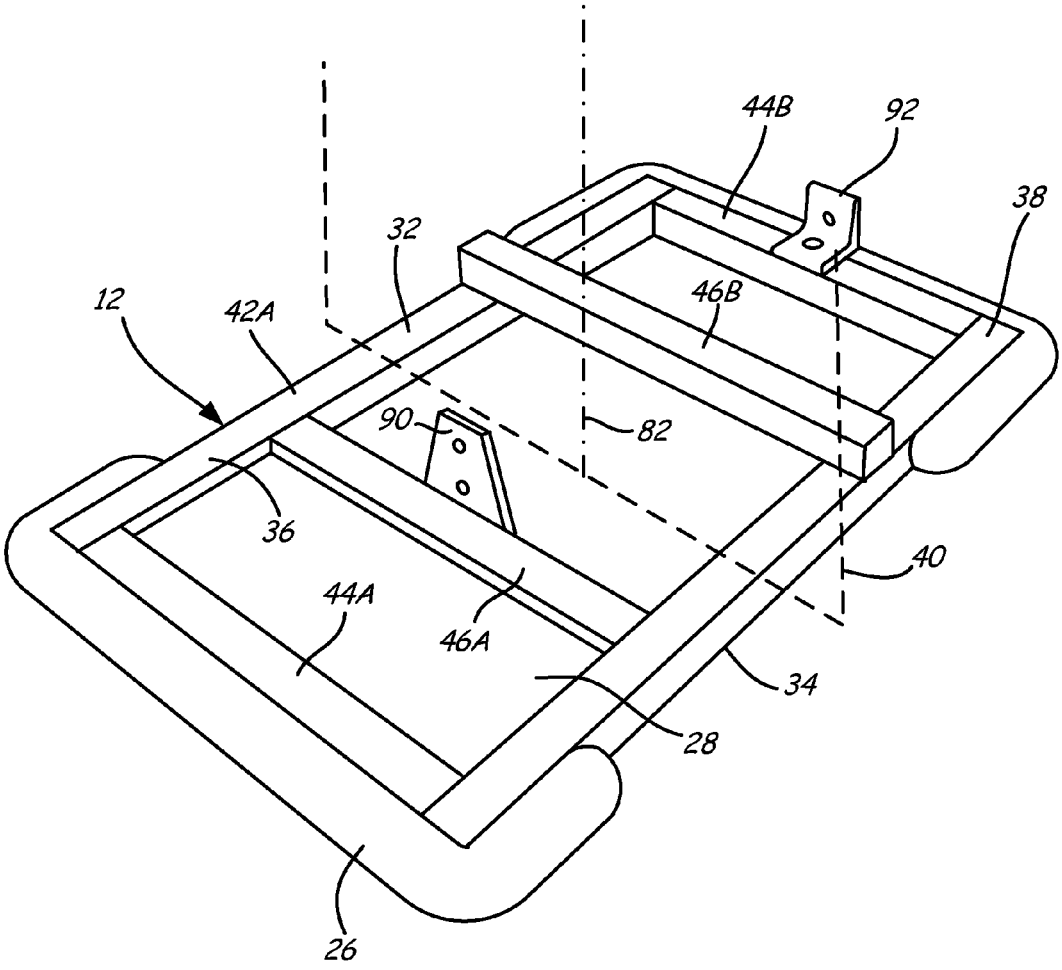
FIG. 2 is a perspective view of a portion of the mobility chair illustrated in FIG. 1.

The objects and advantages described above together with other objects, features, and advances represented by the present invention will now be presented in terms of detailed embodiments described with reference to the figures which are intended to be representative of various embodiments of the invention. Other embodiments and aspects of the invention are recognized as being within the grasp of those having ordinary skill in the art.

Unless otherwise apparent or stated, directional references, such as "upper", "lower", "front", "rear", "frontward", "rearward", "vertical", "horizontal", "upwardly", and the like are intended to be relative to the orientation of a particular embodiment of the invention as shown in the figures. In addition, a given reference numeral in the drawings indicates the same or similar structure when it appears in different figures, and like reference numerals identify similar structural elements and/or features of the subject invention.

With reference now to the drawing figures, a mobility chair 10 includes a frame 12 and a seat 14 secured to frame 12, wherein seat 14 includes a base portion 16 with a seat surface 18 defining a seating zone 20 at which a user sits. Mobility chair 10 further includes a first wheel set 22 rotatably secured to frame 12 about a first axle axis 24. In the embodiment illustrated in FIG. 1, mobility chair 10 may include protective bumpers 26 secured to frame 12, and a footrest 28.

Figure 3:
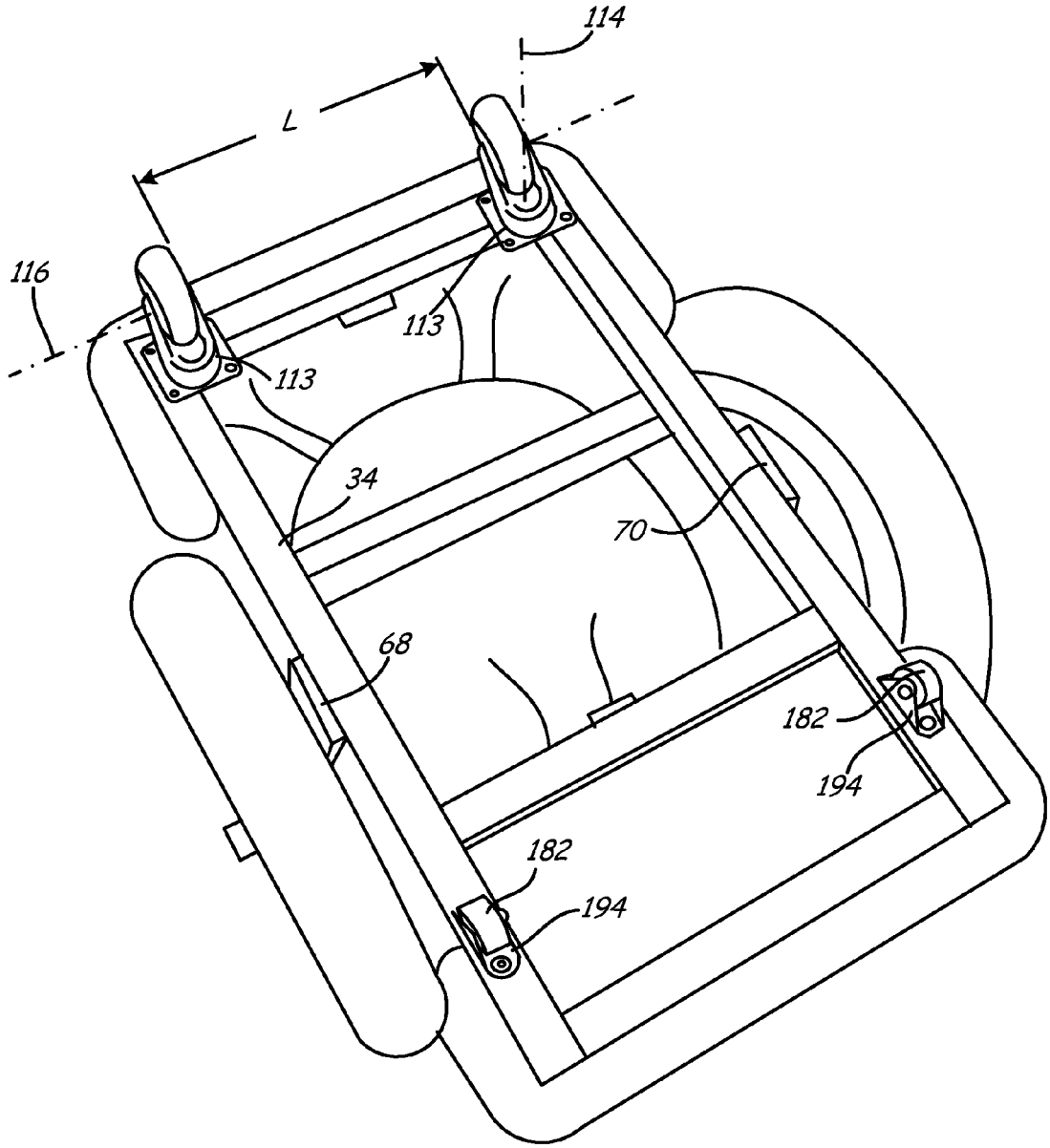
FIG. 3 is a bottom perspective view of the mobility chair illustrated in FIG. 1.
Figure 4:
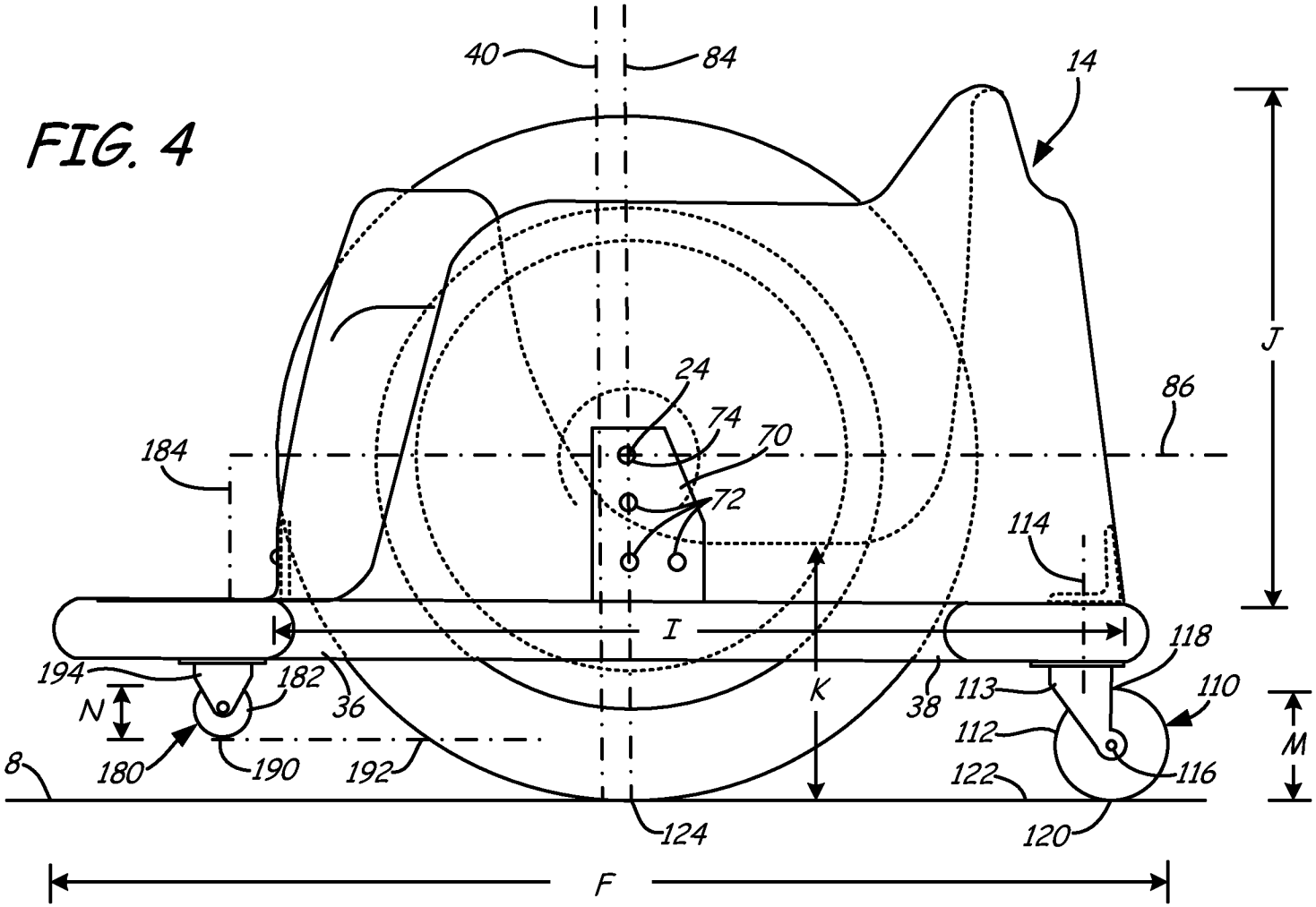
FIG. 4 is a side elevational schematic illustration of the mobility chair illustrated in FIG. 1.
Figure 5:
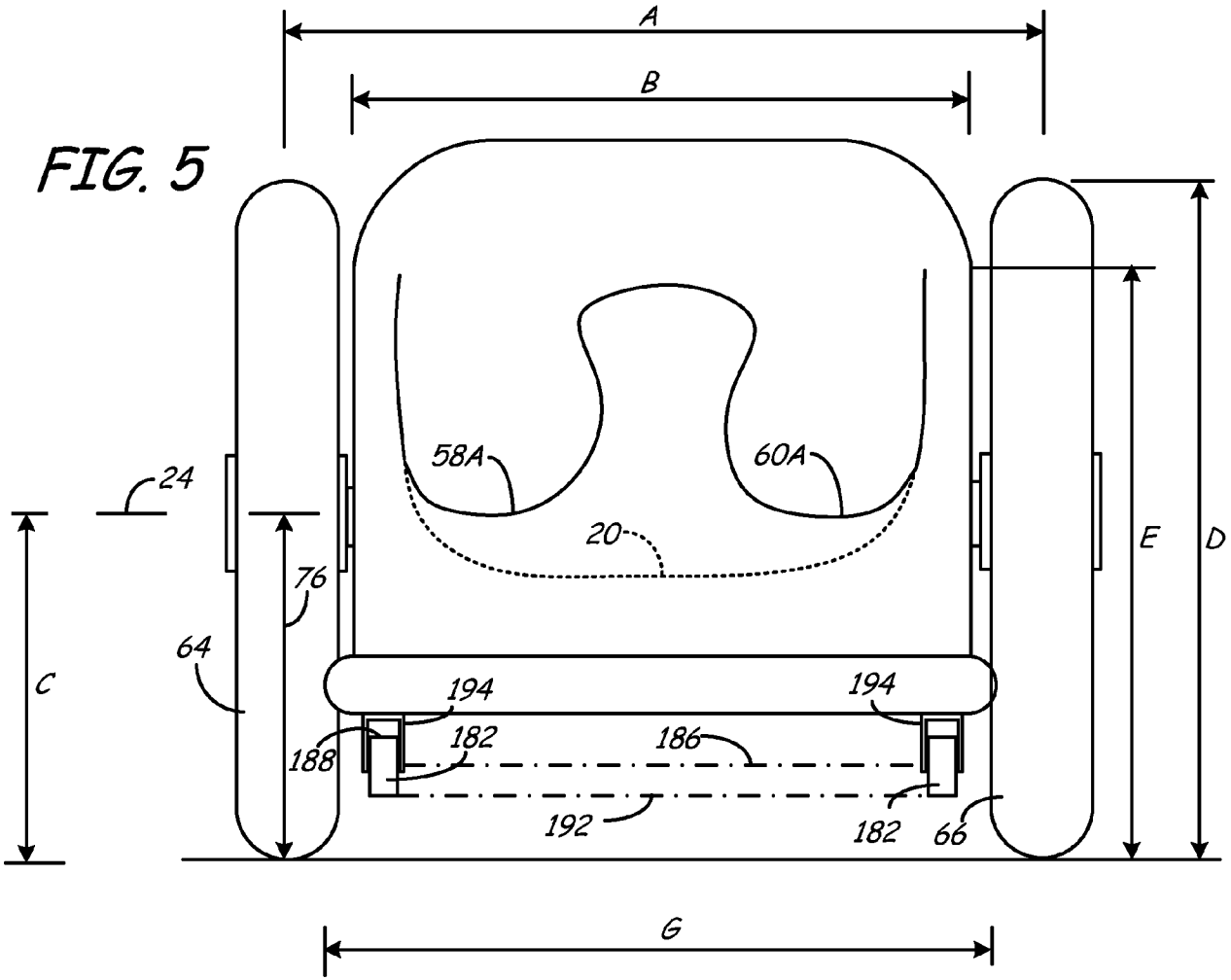
FIG. 5 is a front elevational schematic illustration of the mobility chair illustrated in FIG. 1.

Frame 12 includes an upper side 32 and a lower side 34, and a front portion 36 and a rear portion 38 bisected by a vertical bisection plane 40 that extends vertically through a midline of frame 12 as mobility chair 10 is positioned in its primary operational orientation on a flat floor or ground surface 8, such as that illustrated in FIG. 3. Therefore, frame 12 is bisected by bisection plane 40 into front portion 36 and rear portion 38. In the illustrated embodiment, frame 12 is constructed of aluminum extrusion members, including first and second members 42A, 42B, front and rear members 44A, 44B, and cross-brace members 46A, 46B. The individual members may be secured together with fasteners, adhesives, weldments, soldering, and the like. It is also contemplated that frame 12 may be fabricated from other materials, including metals and/or plastics, and may be constructed from a plurality of individual members, or may instead be integrally molded, stamped, or forged. Footrest 28 may be secured to front portion 36 of frame 12 with fasteners, adhesives, or the like in a position frontwardly of seat 14 to provide a surface upon which a user may rest their feet. In one embodiment, footrest 28 may be manufactured from ultra-high molecular weight (UHMW) plastic, though other durable materials are contemplated as being useful therefor. Likewise, protective bumpers 26 may be secured to frame 12 in any suitable manner, and are fabricated from plastics or other material which serve to protect objects from damage upon impact by mobility chair 10.

Seat 14 may be variously configured and fabricated to meet the needs of mobility chair 10. In one aspect of the present invention, mobility chair 10 may be specifically arranged for use by small children who may not possess strong upright sitting abilities. Consequently, seat 14 may be configured to assist the user in maintaining an upright seated orientation, and for securely retaining the user at seating zone 20 during the maneuvering of mobility chair 10. The illustrated embodiment of seat 14 involves a unitary molded body having sidewalls 52, 56 and a rear wall 54 extending upwardly from a perimeter 21 of seating zone 20 to aid in retaining the user at seat 14. Seating zone 20 may be depressed relative to leg openings 58, 60 that are defined between a torso retainer 62 and respective sidewalls 52, 56. The depressed region defining seating zone 20, in combination with torso retainer 62 and sidewalls 52, 56 and rear wall 54 provide a secure seating environment for the user. The one-piece unitary molded body of seat 14 in the illustrated embodiment may be molded from a polyurethane or other plastic material. It has been determined that the moldable polyurethane polymer may result in a soft and resilient seating surface 18 for seat 14.

Figure 6:
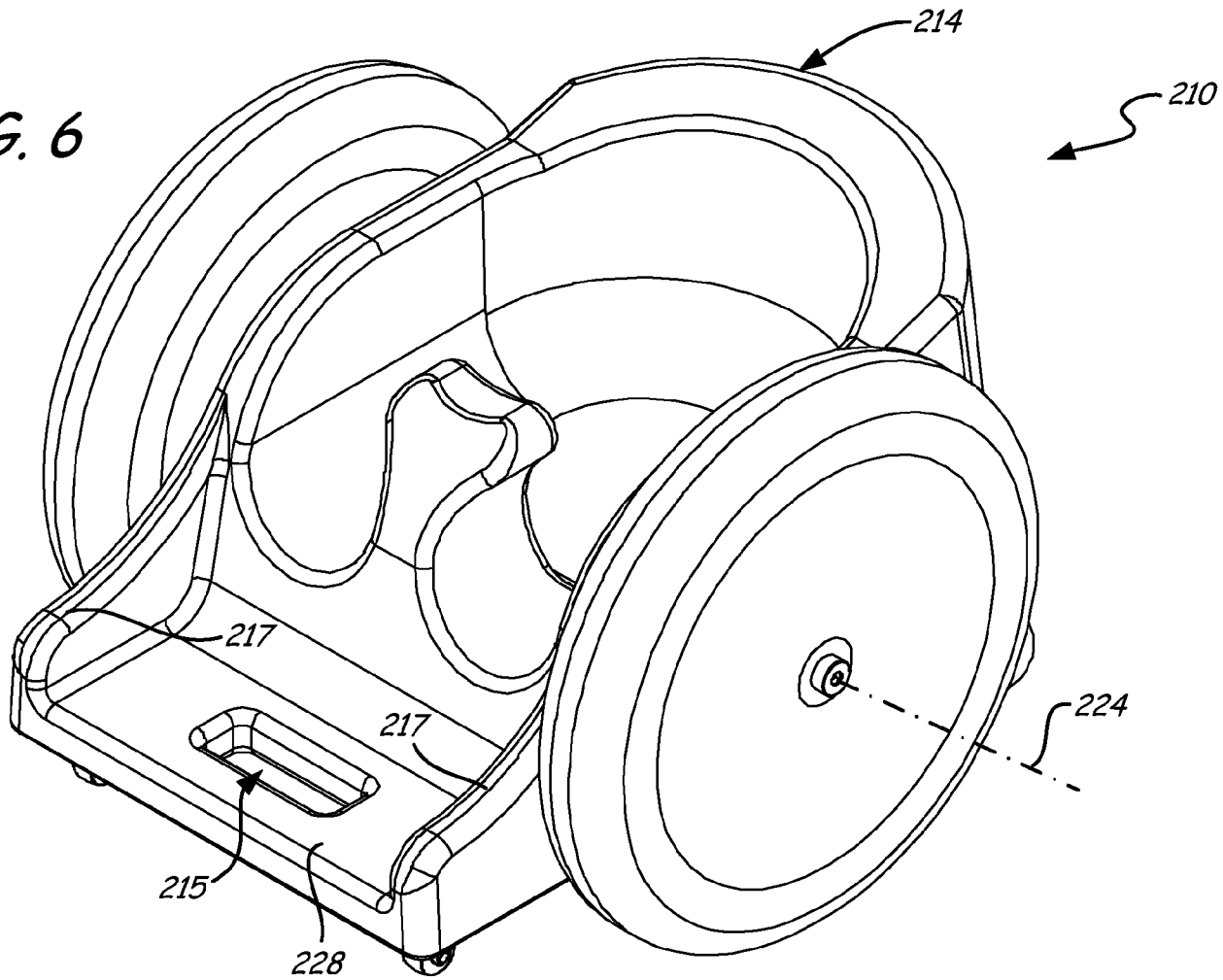
FIG. 6 is a perspective view of a mobility chair of the present invention.
Figure 7:
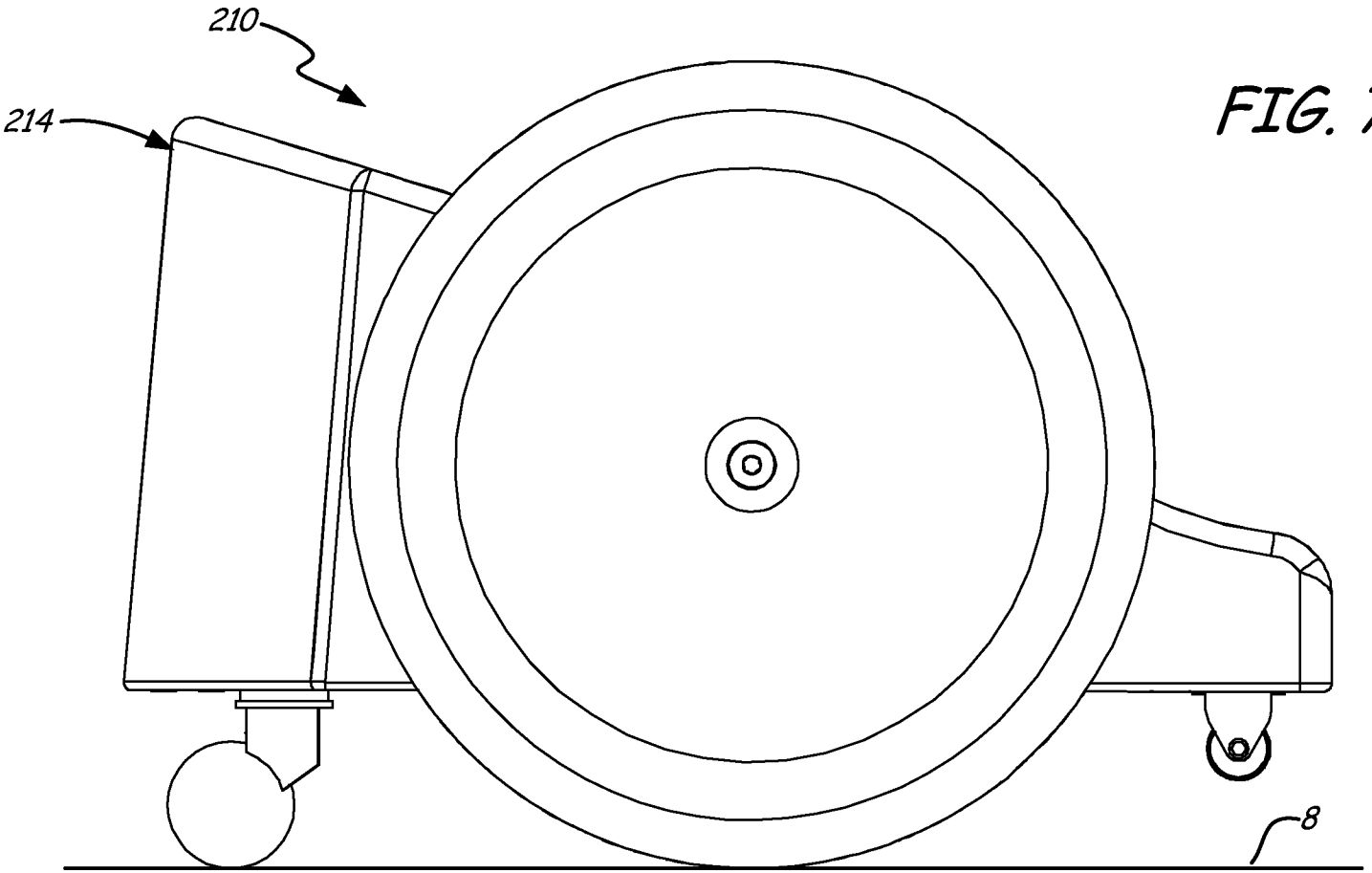
FIG. 7 is a side elevational view of the mobility chair illustrated in FIG. 6.
Figure 8:
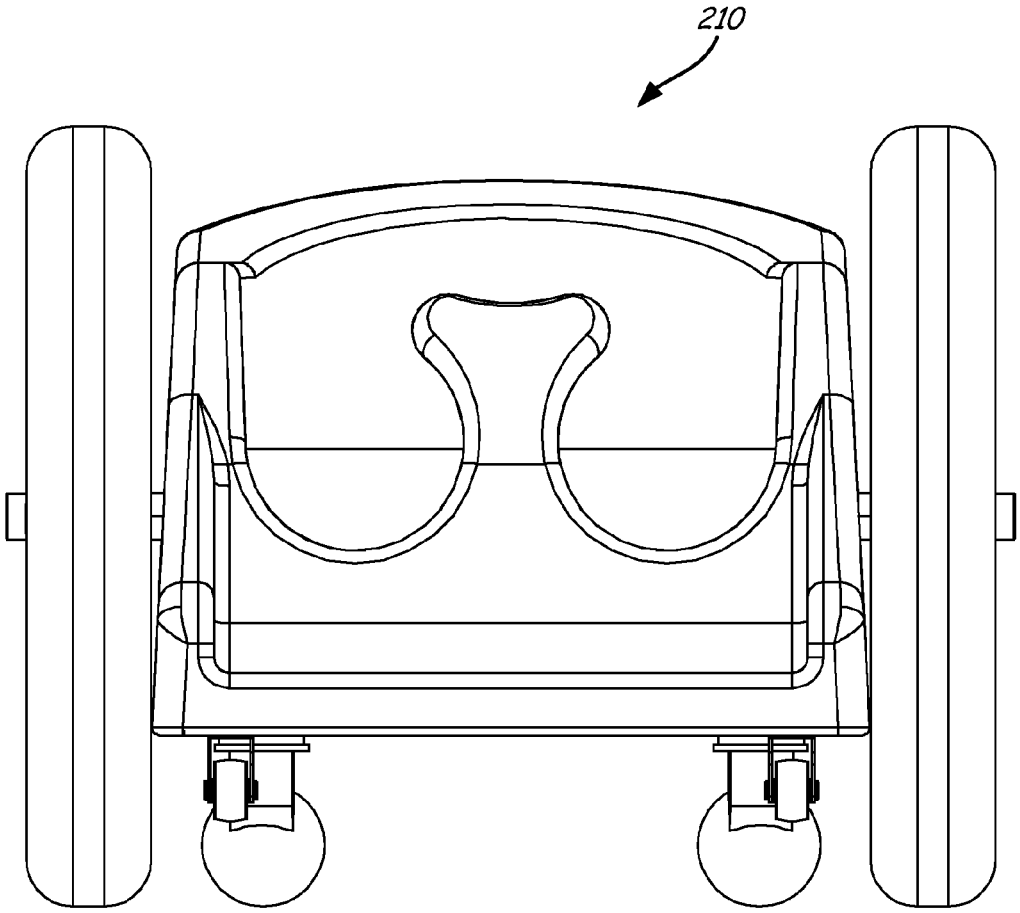
FIG. 8 is a front elevational view of the mobility chair illustrated in FIGS. 6 and 7.
Figure 9:
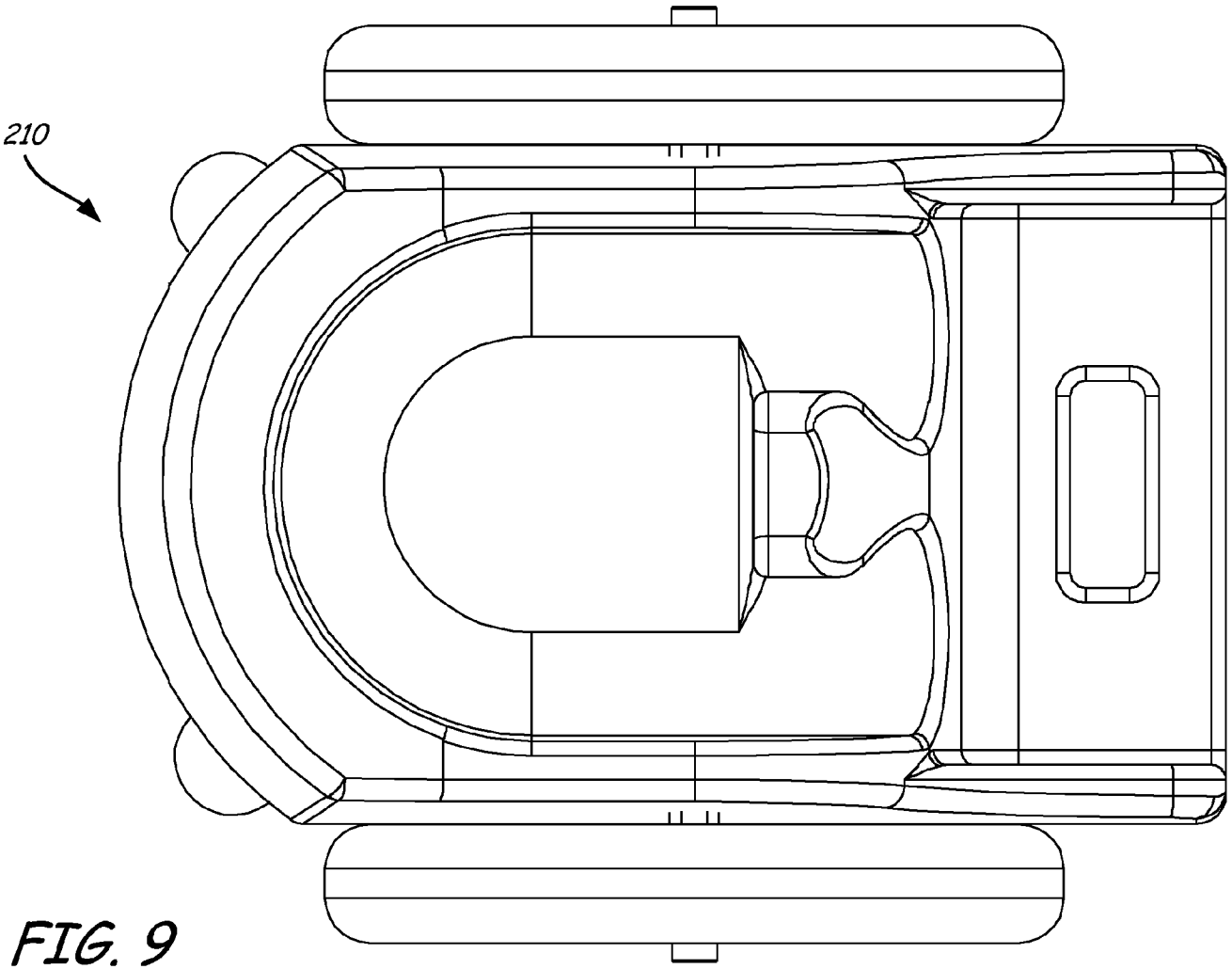
FIG. 9 is a top plan view of the mobility chair illustrated in FIGS. 6-8.

First wheel set 22 may be rotatably secured to frame 12 about first axle axis 24. In the illustrated embodiment, first wheel set 22 includes first and second wheels 64, 66 that are axially spaced apart along first axle axis 24 by a first wheel spacing dimension "A", which is measured between the respective vertical centerplanes of first and second wheels 64, 66. In order to enhance the maneuverability of mobility chair 10, first wheel spacing dimension A is preferably minimized, but not to an extent that jeopardizes stability. In one embodiment, first wheel spacing dimension A may be between about 10-16 inches, and is preferably only slightly larger than a seat width dimension "B". As illustrated in FIG. 6, first and second wheels 64, 66 may be secured to frame 12 through first wheel brackets 68, 70, which may include a plurality of apertures 72 through which a mounting bolt 74 may be inserted to secure a respective wheel 64, 66 to bracket 68, 70. The various apertures 72 provide for adjustment of first axle axis 24 relative to frame 12. First wheel brackets 68, 70 may be secured to frame 12 by fasteners or the like. Mounting bolt 74 may secure a respective wheel 64, 66 to one of first wheel brackets 68, 70 in a manner permitting rotation of the wheel about first axle axis 24 defined by bolt 74. Such a rotational engagement is well understood by those of ordinary skill in the art.

First and second wheels 64, 66 include a first radius 76 that defines a first axle height dimension "C" of first axle axis 24. It has been determined by the applicants that a desirably stable mobility chair 10 may be obtained with a relatively large ratio of first wheel spacing dimension A to first axle height C, in effect creating a "low" and "wide" mobile platform for mobility chair 10. First wheel spacing dimension A may preferably be greater than first axle height C, and may more preferably be at least twice the magnitude of first axle height C for an A:C ratio of >2:1. In some embodiments, first axle height dimension C may be between 4-8 inches. Wheel diameter dimension "D" may typically be between about 8-16 inches, though other wheel sizes are contemplated as being useful in the present invention. First and second wheels 64, 66 may include pneumatic tires 80, though solid plastic wheels 64, 66 are also contemplated in the present invention. The dimensions herein described for wheels 64, 66 include any "tire" portion of the wheel, wherein the tires are considered to be a portion of the wheels insofar as the wheel dimensions are construed herein.

In some embodiments, wheel diameter dimension D is greater than a sidewall height dimension "E", as measured from ground or floor surface 8 to an upper edge 53, 57 of sidewalls 52, 56 of seat 14. In such an arrangement, an upper portion of first and second wheels 64, 66 extend beyond upper edges 53, 57 of sidewalls 52, 56 of seat 14, thereby providing easy access to manipulation of first and second wheels 64, 66 by the user. Motivation of mobility chair 10 is primarily provided by the user manipulating first and second wheels 64, 66 of first wheel set 22. By configuring seat 14 between first and second wheels 64, 66, and with upper edges 53, 57 of sidewalls 52, 56 below an upper portion of wheels 64, 66, the user may easily grasp the wheels 64, 66 to selectively rotate them about first axle axis 24. Preferably, first and second wheels 64, 66 have independent axles defined by mounting bolts 74 to respective first wheel brackets 68, 70 so that first and second wheels 64, 66 may be independently rotated about first axle axis 24. In fact, first and second wheels 64, 66 may be simultaneously oppositely rotated about first axle axis 24 to pivot mobility chair 10 about a vertical pivot axis 82 extending through chair 10.

A first axle plane 84 extends through first axle axis 24, and in parallel to bisecting plane 40. A second axle plane 86 also extends through first axle axis 24, and is perpendicular to bisecting plane 40. First and second axle planes 84, 86, as well as bisecting plane 40 are used herein to assign relative locations and dimensions of various elements of mobility chair 10. Such reference planes are illustrated in FIG. 3.

Seat 14 may be secured to frame 12 at seat brackets 90, 92, such as through fasteners and the like. In one embodiment, bolts 94 may extend through seat 14 and secured to respective seat brackets 90, 92 with nuts 96 and washers 98. Seat brackets 90, 92 may themselves be secured to frame 12 with fasteners, weldments, soldering, or the like. Seat 14 may be secured to frame 12 at a specific position with respect to first wheel set 22 so that a center of gravity of a combined weight of a user and mobility chair 10 is located rearwardly from first axle plane 84 when the user is seated at seat 14 with the user's back against rear wall 54 of seat 14. To assist in locating the center of gravity rearwardly of first axle plane 84, seat 14 may be secured to frame 12 in a somewhat rearwardly shifted position so that seating zone 20 is located rearwardly of first axle plane 84. Such an arrangement is illustrated in FIG. 3, and causes mobility chair 10 to have the tendency in use to pivot about first axle axis 24 against second wheel set 110. Mobility chair 10 therefore tends to pivot rearwardly urging the user back against rear wall 54 of seat 14. Preferably, however, such rearward pivot results only in a substantially horizontal orientation for frame 12 and base portion 16 of seat 14 when chair 10 is on a horizontal ground or floor surface 8. In the event that the user leans forward toward front portion 36 of frame 12, the center of gravity of the combined weight of the user and the mobility chair 10 may shift forwardly of first axle plane 84, thereby causing mobility chair 10 to pivot forwardly upon third wheel set 180. As will be described in greater detail below, such forward pivoting of mobility chair 10 facilitates access by the user to the ground or floor surface 8 in front of and around mobility chair 10, including access to toys and other objects on ground or floor surface 8. Upon movement by the user back into a more upright orientation with respect to rear wall 54 of seat 14, the center of gravity of the combined weight of the user and mobility chair 10 again shifts rearwardly of first axle plane 84, causing mobility chair 10 to pivot rearwardly upon second wheel set 110 for a more natural and comfortable operating position for the user in motivating mobility chair 10.

In one embodiment of the invention, frame 12 may have a length dimension "F" of between about 12 and 24 inches, such as about 18 inches, and a width dimension "G" of between about 6 and 18 inches, such as about 10.5 inches. Chair 14 may have a length dimension "I" of between about 12 and 18 inches, such as about 14 inches, a width dimension B of about 8-12 inches, such as about 10.5 inches, and a height dimension "J" at rear wall 54 of between about 6-12 inches, such as about 9.25 inches. In the illustrated embodiment, seat 14 is non-centrally positioned at frame 14, in order to assist in accomplishing the rearward center of gravity location, and a rearwardly-pivoting tendency for mobility chair 10. Seating surface 20 of chair 14 is preferably located below second axle plane 86, so that seating surface 20 is relatively low with respect to first axle axis 24. Such a relative position assists in lowering the center of gravity of the combined weight of the user and mobility chair 10, and thereby enhancing the stability and maneuverability thereof. In some embodiments, seating surface 20 is positioned so as to have the seating surface height dimension "K" above a ground or floor surface 8 of about 2-6 inches, such as about 4.5 inches.

Figure 10:
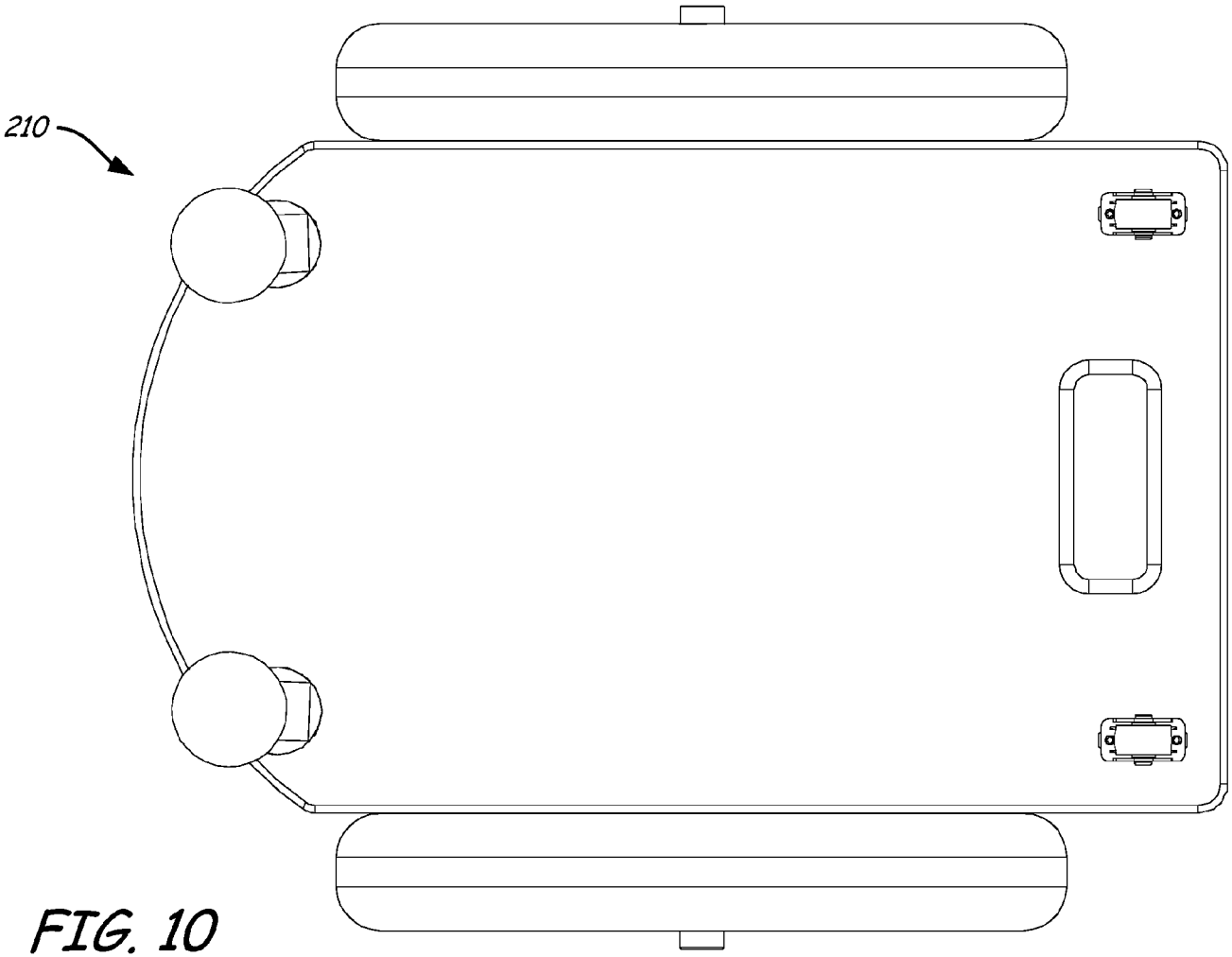
FIG. 10 is a bottom plan view of the mobility chair illustrated in FIGS. 6-9.
Figure 11:
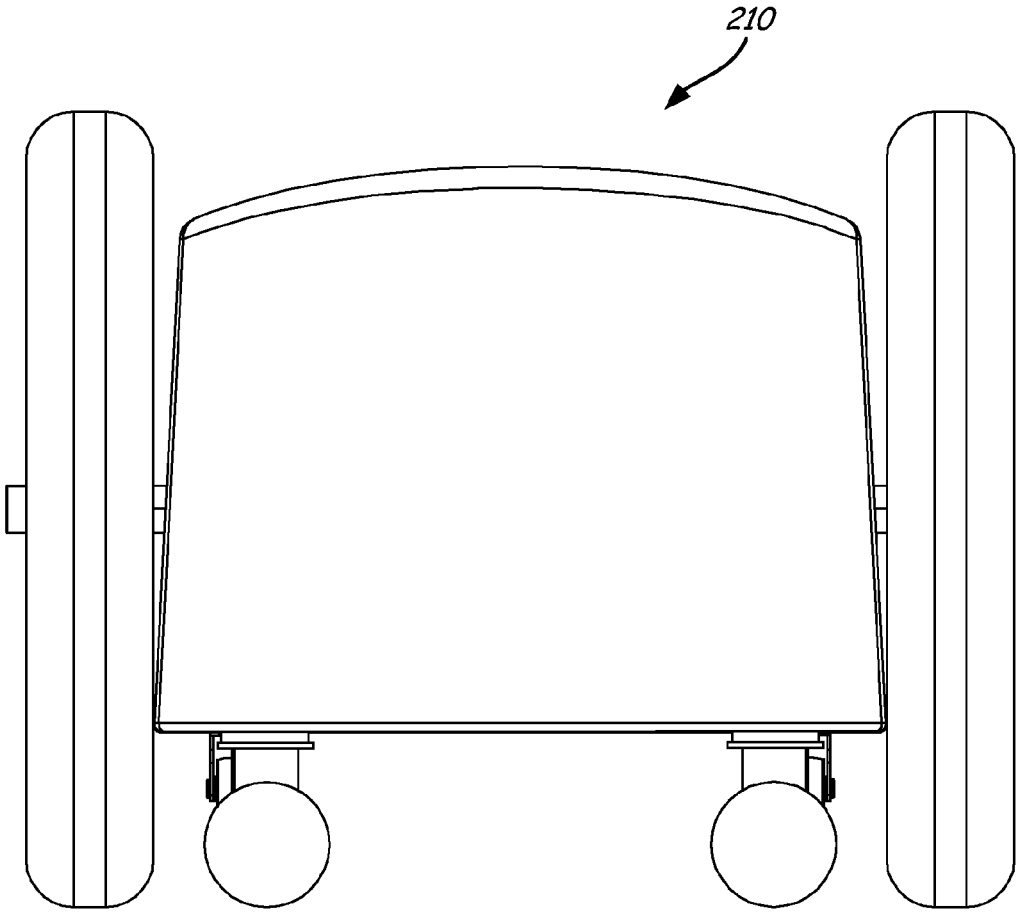
FIG. 11 is a rear elevational view of the mobility chair illustrated in FIGS. 6-10.
Figure 12:
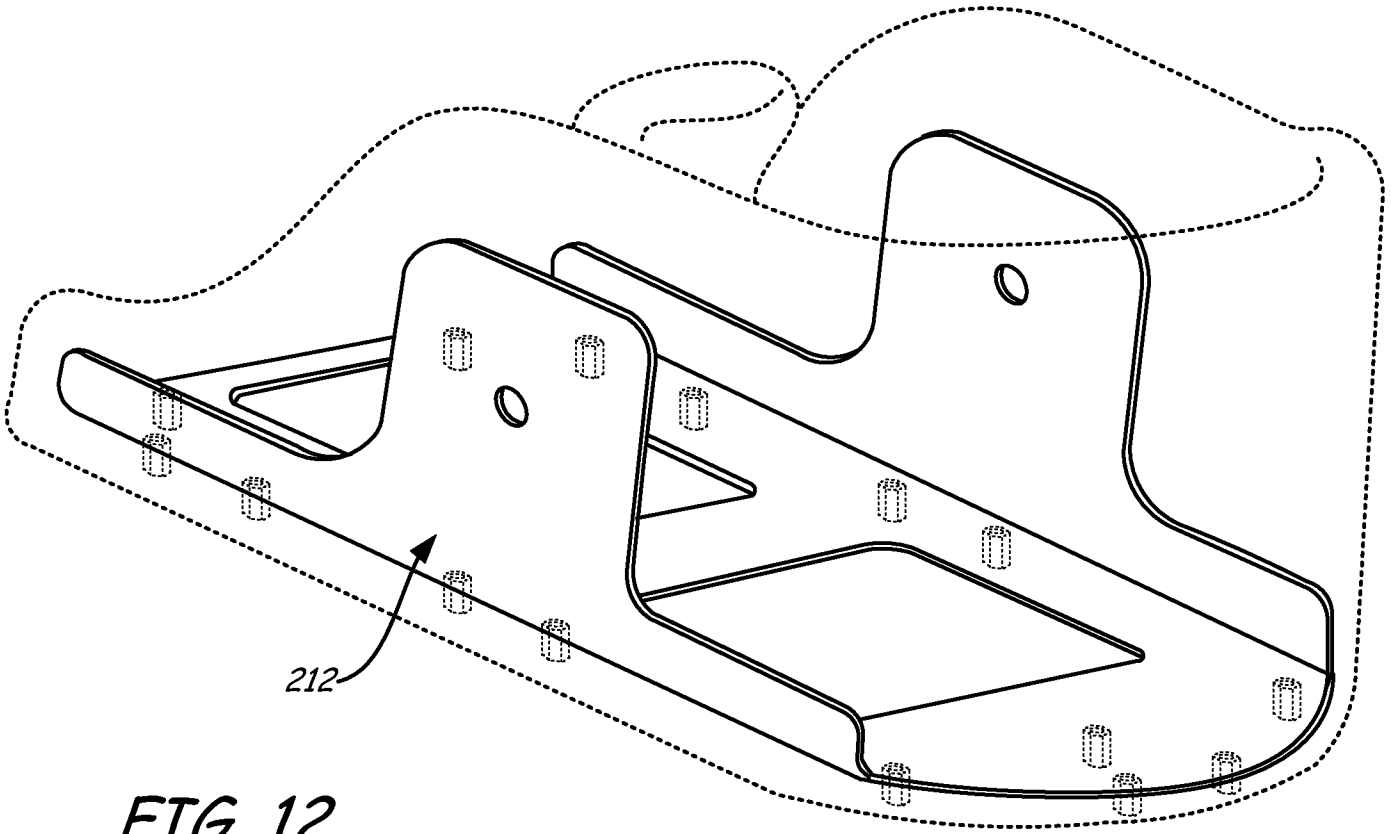
FIG. 12 is a perspective view of hidden structure of the mobility chair illustrated in FIGS. 6-11.

Second wheel set 110 may be secured to frame 12 rearwardly of first axle plane 84 in order to support mobility chair 10 in its operable pivoting about first axle axis 24 rearwardly when the center of gravity location is rearward of first axle plane 84. A bottom view of mobility chair 10 is illustrated in FIG. 10, wherein second wheel set 110 includes one or more pivotable first casters 112 secured to lower side 34 of frame 12. Each of pivotable first casters 112 includes a first pivot axis 114 parallel to bisecting plane 40, and a first rotation axis 116 perpendicular to first pivot axis 114 and below second axle plane 86. Accordingly, casters 112 are pivotable about a respective first pivot axes 114, and rotatable about a respective first rotation axis 116.

First casters 112 of second wheel set 110 each define upper and lower first caster tangent points 118, 120 on a circumference thereof. Lower first caster tangent point 120 is distal from second axle plane 86 relative to upper first caster tangent point 118, and is contained within a first lower tangent plane 122 that is perpendicular to bisecting plane 40. Lower tangent plane 122 extends through a first wheel set tangent point 124 of first and second wheels 64, 66 at an intersection with first axle plane 84. In the illustrated embodiment, second wheel set 110 includes first and second casters 112 secured to frame 12 by caster brackets 113 through fasteners, or the like. In one embodiment, first and second casters 112 may be spaced apart by a first caster spacing dimension "L" of between about 6-12 inches, such as about 8.25 inches, and may have a caster diameter dimension "M" of about 1-4 inches, such as 2 inches. The pivotable casters employed in second wheel set 110 are understood by those of ordinary skill in the art as being readily commercially available.

Third wheel set 180 may be secured to frame 12, such as lower side 34 frame 12, frontwardly of first axle plane 84 to engage ground or floor surface 8 when the center of gravity of the combined weight of the user and mobility chair 10 is shifted frontwardly of first axle plane 84. Third wheel set 180 includes one or more second casters 182 each having a second pivot axis 184 parallel to bisecting plane 40, and a second rotation axis 186 perpendicular to bisecting plane 40 and below second axle plane 86. Second casters 182 may be pivotable about a respective second pivot axis 184, and rotatable about a respective second rotation axis 186.

Second casters 182 of third wheel set 180 each define upper and lower second caster tangent points 188, 190 on a circumference thereof. Lower second caster tangent point 190 is distal from second axle plane 86 relative to upper second caster tangent point 188, and is contained in a second lower tangent plane 192 that is perpendicular to bisecting plane 40 and extends parallel to and between second axle plane 86 and first lower tangent plane 122. Therefore, the positioning of third wheel set 180, with the configuration of second casters 182 resulting in a second lower tangent plane 192 above first lower tangent plane 122, permits the pivoting characteristic of mobility chair 10, as described above.

In one embodiment, second casters 182 may be secured to frame 112 by second caster brackets 194. Second casters 182 may possess a wheel diameter dimension "N" of between about 0.5-3 inches, such as about 1 inch.

Second casters 182 do not touch the floor during normal movement of the chair except when it is tipped forward giving the child the ability to reach things on the floor. These can be adjusted to increase or decrease the amount of tipping forward that is allowable and safe. Moreover, second casters 182 may be replaced by one or more pivot stops that act to arrest forward pivoting motion about first axle axis 224, but do not necessarily include wheels or other rotatable and/or pivotable elements. First casters 112 do not need any adjustments. The height of first casters 112 are typically so that frame 12 is generally level for normal movement of the chair across the floor.

Various alternative embodiments of mobility chair 10 have been envisioned by the applicant. An example alternative embodiment is illustrated in FIGS. 6-12, wherein mobility chair 210 employs a molded seat 214 that is secured about a frame 212. In this approach, mobility chair 210 assumes an integrated aesthetic appearance, with footrest 228 integrally formed with seat 214. The overall configuration of mobility chair 210, however, shares the general concepts described above with respect to mobility chair 10, in particular a relatively low center of gravity and a relatively small first wheel set spacing dimension "A" to obtain both stability and maneuverability. Moreover, mobility chair 210 permits the pivoting characteristic about first axle axis 224 to allow users to reach forward and easily access objects at floor or ground surface 8 without becoming dislodged from seat 214.

The mobility chair may be made for larger children by proportionally increasing the sizes of the parts. At least three sizes can be made to account for various progressions of a child's growth.

The frame may be fabricated from a flat plate that is cut out per a detailed print that identifies the required shape, location and size of holes, and then specifications on which holes are tapped. The plate includes a couple of longer portions that are bent approximately 90 degrees upward and become the connection points for first and second wheels 64, 66. Additional posts may be added to act as anchor points for the molded chair to secure to the frame when it is molded to the frame.

A molded chair may be made to be a fully molded design that is injection molded around the frame and becomes one integrated part with only wheels, casters, and minor accessories needing to be added after the molding process is complete. A variation in colors of the mold may be made by changing the colorant in the polyurethane raw materials prior to the injection process.

A fully integrated molded chair also acts as guarding along the perimeter edges eliminating the need for any additional bumpers/guards.

A foot rest may also be part of the integrated mobility chair design so there are no exposed metal parts anywhere on the upper portion of the footrest, chair and frame.

Seat 214 is integrally molded about a frame 212 and a handle 215 is provided in the footrest 228. Handle 215 may be used alone or in combination with an extension tool so that another user, such as an adult, may easily grasp and manipulate the mobility chair. In addition, footrest sidewall portions 217 are provided in seat 214 in order to secure a user's legs inboard of the wheels. Such a utility may be particularly useful for users with spina bifida or other disabilities which inhibit leg control.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different methods/devices and that various modifications can be accomplished without departing from the scope of the invention itself.

What is claimed is:

1. A mobility chair, comprising:

a frame having a base portion and axle support flanges extending from said base portion;

a first wheel set having first and second wheels axially spaced apart along a first axle axis by a first wheel spacing dimension and secured to said axle support flanges of said frame at respective first and second axles extending outwardly from said axle support flanges along said first axle axis, wherein a first radius of at least one of said first and second wheels defining a first axle height, said first wheel spacing dimension being at least twice said first axle height, and first and second mutually perpendicular axle planes extending through said first axle axis, said first axle plane vertically dividing said chair into front and rear portions;

a seat having a base portion with a seating surface defining a seating zone below said second axle plane at which a user sits facing generally forwardly, said seating zone extending rearward of said first axle plane at a position so that said chair is capable of being forwardly pivoted about said first axle axis under only gravitational force when the user leans forwardly while remaining seated at said seating zone, said seat including side walls and a rear wall extending upwardly from a perimeter of said seating zone, said side walls disposed at said axle support flanges with said first and second axles protruding from respective said side walls, wherein said side walls define a seat width dimension of said seat that is only slightly smaller than said first wheel spacing dimension; and a second wheel set having at least one third wheel for limiting rearward pivoting motion of said chair about said first axle axis, said third wheel being positioned rearwardly of said first axle plane and defining a lower third wheel tangent point distal from said first axle plane and contained within a first lower plane that is perpendicular to said first axle plane, said first lower plane extending through a first wheel set tangent point of said first and second wheels at an intersection with said first axle plane.

2. A mobility chair as in claim 1, including a third wheel set positioned forwardly of said first axle plane and comprising at least one fourth wheel defining a lower tangent point distal from said second axle plane and contained within a second lower plane that is perpendicular to said first axle plane, said second lower plane extending parallel to and between said second axle plane and said first lower plane.

3. A mobility chair as in claim 1 wherein said first wheel spacing dimension is between 10-16 inches.

4. A mobility chair as in claim 3 wherein a height of said seating surface is between 2-6 inches from said first lower plane.

5. A mobility chair as in claim 1 wherein said base portion, said side walls, and said rear wall of said seat are formed as a single molded unit.

* * * * *